US012509833B2

(12) United States Patent
Considine

(10) Patent No.: US 12,509,833 B2
(45) Date of Patent: Dec. 30, 2025

(54) SPRING LOADED LIFT FRAME FOR A SNOWPLOW ASSEMBLY

(71) Applicant: Buyers Products Company, Mentor, OH (US)

(72) Inventor: Anthony Considine, Mentor, OH (US)

(73) Assignee: BUYERS PRODUCTS COMPANY, Mentor, OH (US)

( * ) Notice: Subject to any disclaimer, the term of this patent is extended or adjusted under 35 U.S.C. 154(b) by 436 days.

(21) Appl. No.: 18/179,595

(22) Filed: Mar. 7, 2023

(65) Prior Publication Data

US 2024/0301640 A1 Sep. 12, 2024

(51) Int. Cl.
*E01H 5/06* (2006.01)

(52) U.S. Cl.
CPC ..... *E01H 5/062* (2013.01); *E01H 5/066* (2013.01)

(58) Field of Classification Search
CPC ..... E01H 5/062; E01H 5/066
See application file for complete search history.

(56) References Cited

U.S. PATENT DOCUMENTS

| | | | | |
|---|---|---|---|---|
| 2,430,221 | A * | 11/1947 | Frink | E01H 5/06 37/231 |
| 5,082,065 | A * | 1/1992 | Fletcher | A01B 71/06 37/231 |
| 6,393,737 | B2 * | 5/2002 | Quenzi | E01H 5/06 37/234 |
| 10,472,783 | B2 * | 11/2019 | Rich | E01H 10/007 |
| 2019/0257047 | A1 * | 8/2019 | Moorman | E01H 5/066 |
| 2020/0217030 | A1 * | 7/2020 | Briggs | E01H 5/063 |

* cited by examiner

*Primary Examiner* — Theodore N Yao
(74) *Attorney, Agent, or Firm* — Emerson, Thomson & Bennett LLC; Roger D. Emerson

(57) ABSTRACT

This disclosure describes a snow plow assembly for a vehicle including a push frame to which a moldboard is mountable for enabling removal of snow and a lift frame configured for mounting to the vehicle. A lift device is mounted to the lift frame to vertically raise or lower the push frame and the moldboard. A first coupling and a second coupling, attaching respective left and right sides of the push frame to corresponding sides of the lift frame. The couplings each include a spring for mounting between the push frame and the lift frame, each of the springs including weldments at opposite ends of each spring for attaching to the push frame and to the lift frame. The springs provide support to the lift frame to help prevent the snow plow assembly from falling over when detached from the vehicle and to reduce movement during transport.

6 Claims, 7 Drawing Sheets

SPRING LOADED LIFT FRAME FOR A SNOWPLOW ASSEMBLY

I. BACKGROUND

A. Technical Field

The present invention relates generally to snow plows, and more particularly to snow plow assemblies having a floating A-frame.

B. Description of Related Art

Snow plow assemblies are used on commercial, residential, or all-purpose vehicles for the effective removal of snow from the ground. A typical snow plow assembly includes a mounting frame coupled to a moldboard assembly for plowing the snow, a push frame pivotably connected to the mounting frame for allowing lateral pivoting movement of the mounting frame and moldboard assembly, and a lift frame operatively coupled to the push frame for vertically raising or lowering the push frame and the mounting frame.

Snow plow assemblies are known to travel over irregular or uneven ground surfaces, which can cause uneven removal of snow from the ground. Also, snow plow assemblies are known to experience a significant amount of pushing and pulling force during normal use, which can cause a significant amount of stress and wear on the snow plow assembly. Such known problems are overcome by the solutions disclosed in U.S. Pat. No. 10,801,172, commonly assigned to the present assignee, the entire disclosure of which is incorporated by reference herewith.

The snow plow assembly of the aforementioned reference has been found to be unstable under certain circumstances. During mounting and removal from the vehicle, the snow plow assembly tends to fall forward, requiring two personnel, one person to hold the snow plow steady and the other person to effect the mounting or removal. Also, the snow plow assembly tends to be unstable when removed and set upon a sloped surface.

II. SUMMARY

Provided in this disclosure is a snow plow assembly for a vehicle including a push frame to which a moldboard is mountable for enabling removal of snow and a lift frame configured for mounting to the vehicle. A lift device is mounted to the lift frame. The lift device is configured to vertically raise or lower the push frame and the moldboard relative to a horizontal plane. A first coupling is provided for attaching a left side of the push frame to a corresponding left side of the lift frame. A second coupling is provided for attaching a right side of the push frame to a corresponding right side of the lift frame. The first and second couplings each include a spring for mounting between the push frame and the lift frame. Each of the springs include a first weldment at a first end of the respective spring for attaching to the push frame. Each spring is mounted concentrically around a respective bar, which is inserted through an aperture in a strut secured to the lift frame at a second end of the spring, opposite from the first end, for attaching to the lift frame. The springs provide support to the lift frame to help prevent the snow plow assembly from falling over when detached from the vehicle.

Also provided in this disclosure is a snow plow assembly for a vehicle including a push frame to which a moldboard is mountable for enabling removal of snow and a lift frame configured for mounting to the vehicle. A lift device is mounted to the lift frame. The lift device is configured to vertically raise or lower the push frame and the moldboard relative to a horizontal plane. A first coupling is provided for attaching a left side of the push frame to a corresponding left side of the lift frame. A second coupling is provided for attaching a right side of the push frame to a corresponding right side of the lift frame. The first and second couplings each include a spring for mounting between the push frame and the lift frame. Each of the springs include a first weldment at a first end of the respective spring for attaching to the push frame. Each spring is mounted concentrically around a respective bar, which is inserted through an aperture in a strut secured to the lift frame at a second end of the spring, opposite from the first end, for attaching to the lift frame. The first and second couplings each include a bearing block having an opening that receives a retaining member that operatively couples the push frame to the lift frame. The first and second couplings each include a spring for mounting between the push frame and the lift frame. Each of the springs further comprise a first weldment at a first end of the respective spring for attaching to the push frame, and a second weldment at a second end of the respective spring, opposite from the first end, for attaching to the lift frame. The springs provide support to the respective retaining members and provide a biasing force against the respective retaining members, resulting in a balancing force that maintains centering of the snow plow assembly.

Additionally provided in this disclosure is a snow plow assembly for a vehicle including a push frame to which a moldboard is mountable for enabling removal of snow and a lift frame configured for mounting to the vehicle. A lift device is mounted to the lift frame. The lift device is configured to vertically raise or lower the push frame and the moldboard relative to a horizontal plane. A first coupling is provided for attaching a left side of the push frame to a corresponding left side of the lift frame. A second coupling is provided for attaching a right side of the push frame to a corresponding right side of the lift frame. The first and second couplings each include a spring for mounting between the push frame and the lift frame. Each of the springs include a first weldment at a first end of the respective spring for attaching to the push frame, and a second weldment at a second end of the respective spring, opposite from the first end, for attaching to the lift frame. The first and second couplings each include a bearing block having an opening that receives a retaining member that operatively couples the push frame to the lift frame. The respective bearing blocks of the first and second couplings are configured to vertically move with the respective retaining members when the snow plow assembly is in use to thereby allow each of the left and right sides of the push frame to float vertically relative to the respective left and right sides of the lift frame. They are configured to allow the left and right sides of the push frame to float vertically independently of one another, thereby allowing the push frame to rotate relative to the lift frame about a longitudinal axis extending in a forward direction, which enables the snow plow assembly to accommodate for irregular or uneven ground surfaces when the snow plow assembly is in use. The first and second couplings each include a spring for mounting between the push frame and the lift frame. Each of the springs also include a first weldment at a first end of the respective spring for attaching to the push frame. Each spring is mounted concentrically around a respective bar, which is inserted through an aperture in a strut secured to the lift frame at a second end of the spring, opposite from the first end, for attaching to the lift frame. The springs provide support to the lift frame to help prevent the snow plow assembly from falling over when detached from the vehicle, and to provide a biasing force against the respective retaining members, resulting in a balancing force that maintains centering of the snow plow assembly.

In any of the aforementioned embodiments, the snow plow assembly can also include one or more stand assemblies, vertically adjustable downward to support some or all of the snow plow assembly when detached from the vehicle.

According to an aspect, the present invention provides stability to the snow plow assembly.

According to another aspect, the present invention prevents the snow plow assembly from falling forward.

According to yet another aspect, the present invention enables the snow plow assembly to be mounted and removed by a single user.

According to still another aspect, the present invention enables the snow plow assembly to be stable when removed and set upon a sloped surface.

According to a further aspect, the present invention holds the lift frame up when the plow is removed.

According to another further aspect, the present invention makes the plow easier to get on the truck.

Other benefits and advantages of this invention will become apparent to those skilled in the art to which it pertains upon reading and understanding of the following detailed specification.

III. BRIEF DESCRIPTION OF THE DRAWINGS

The disclosed lift frame assembly may take physical form in certain parts and arrangement of parts, embodiments of which will be described in detail in this specification and illustrated in the accompanying drawings which form a part hereof and wherein.

Figure 4A:
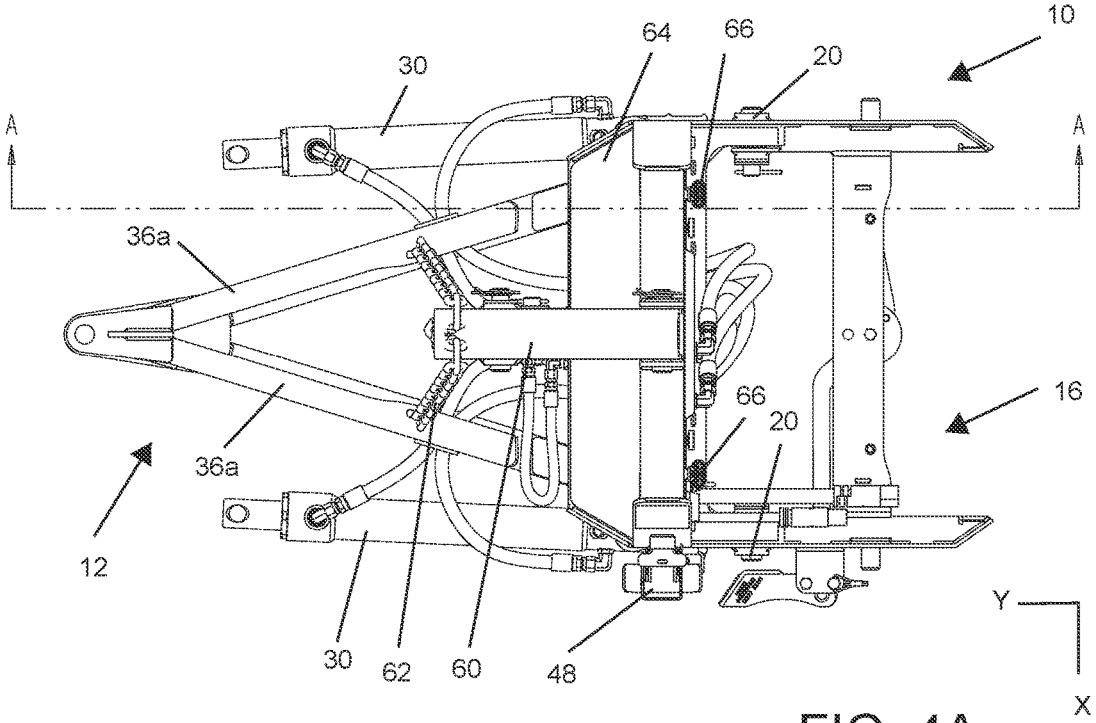
FIGS. 4A and 4B are respective top and bottom views of the present snow plow assembly in accordance with the present invention.
Figure 4B:
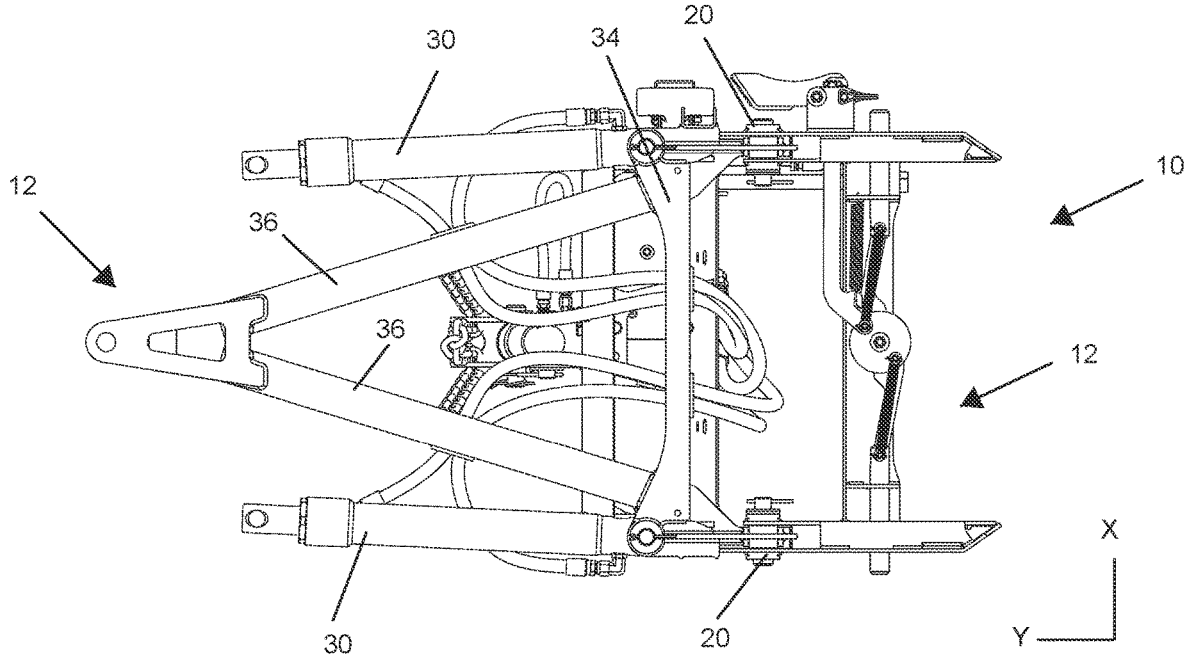
Figure 5A:
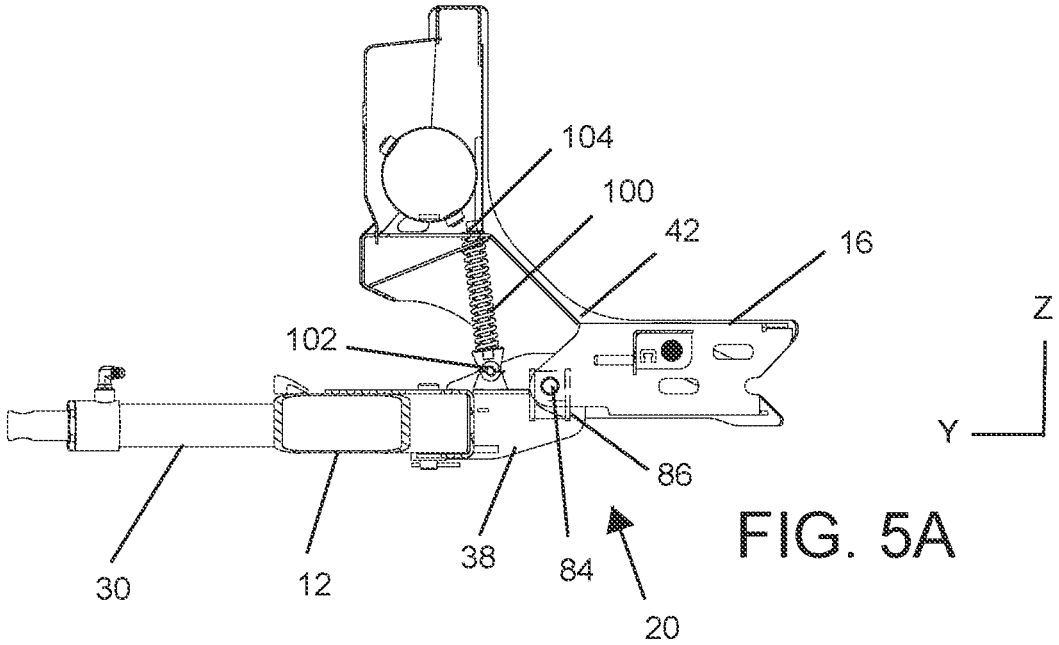
Figure 5B:
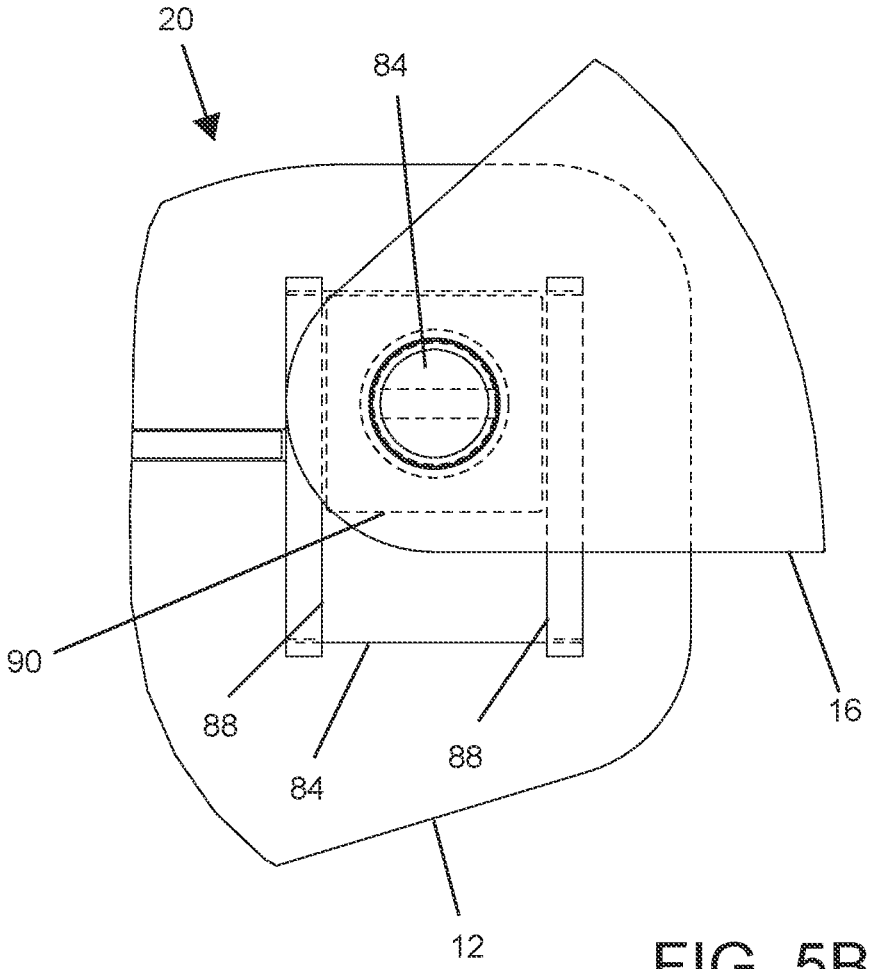
Figure 5C:
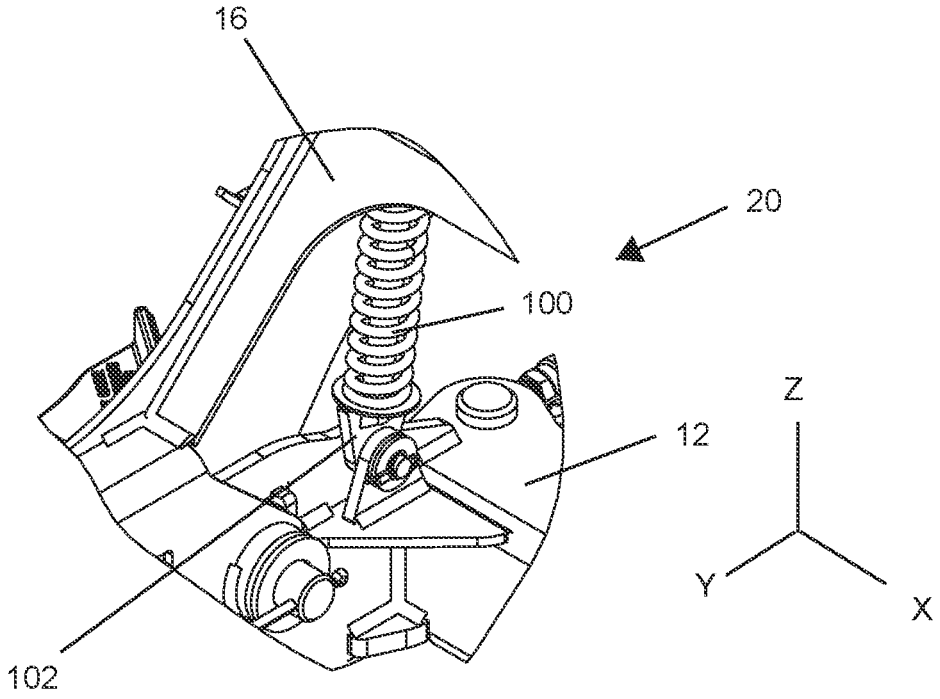
Figure 5D:
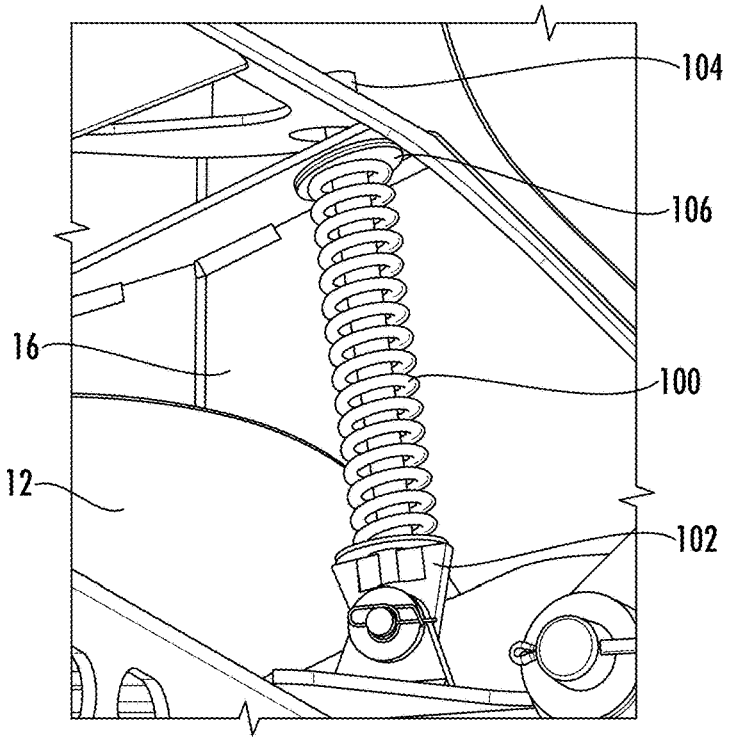
Figure 5E:
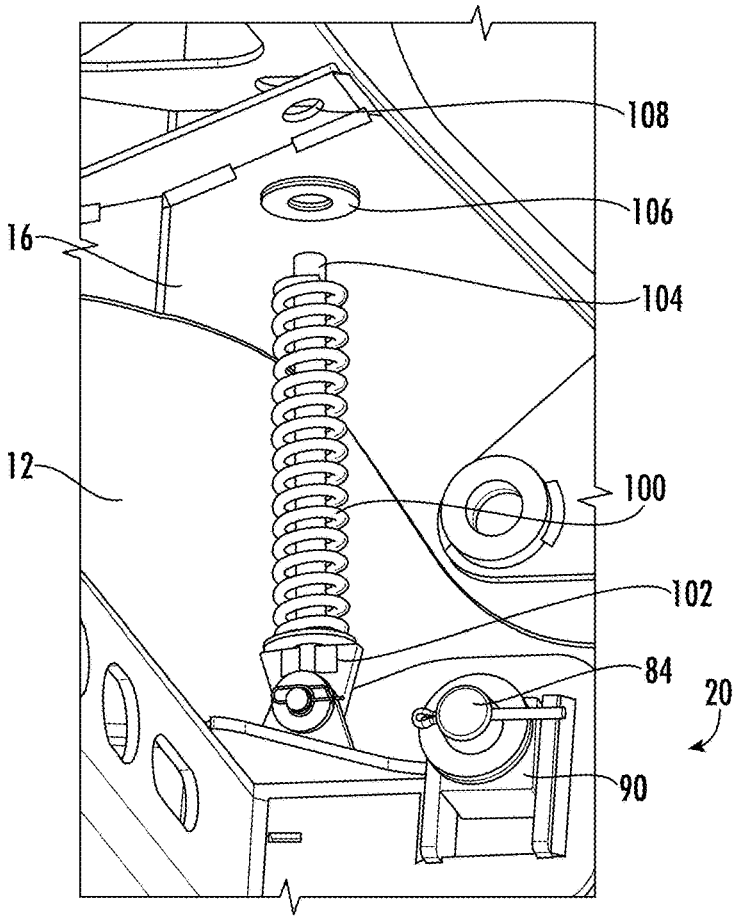

FIGS. 5A, 5B, 5C, 5D, and 5E are respective views of the couplings in accordance with the present invention where FIG. 5A is a view taken along section A-A of FIG. 4A, FIG. 5B is a side detail view of a coupling, FIG. 5C is a perspective view of the spring, and FIGS. 5D and 5E are respective side assembled and exploded views of the spring.

IV. DETAILED DESCRIPTION

Reference is now made to the drawings wherein the showings are for purposes of illustrating embodiments of the article only and not for purposes of limiting the same, and wherein like reference numerals are understood to refer to like components.

The principles of the present invention have particular application to snow plow assemblies for a vehicle, including commercial, residential, or all-purpose vehicles, and will be described below chiefly in this context. It is also understood, however, that the principles of the present invention may be applicable to other plow assemblies or vehicle-mounted accessories for other applications where it is desirable to provide one or more couplings that allow a push frame to be floatably coupled to a lift frame for accommodating irregular or uneven ground surfaces; and/or where it is desirable to provide one or more bearing blocks in the coupling to improve the load distribution on the push frame to reduce wear.

In the discussion above and to follow, the terms "upper", "lower", "top", "bottom,""inner,""outer,""left,""right, ""above,""below,""horizontal,""vertical," etc. refer to the snow plow assembly as viewed in a horizontal position, as shown in FIG. 1, for example. As generally used herein, and unless otherwise provided in a different context, the terms forward and rearward are used synonymously with being in a longitudinal direction of the snow plow assembly, which is generally designated in the Y-direction in the figures; the terms left and right are used synonymously with being in a transverse or lateral direction, which is generally designated in the X-direction in the figures; and the terms upwards, downwards, vertical, or the like are used synonymously with being in a vertical direction, which is generally designated in the Z-direction in the figures. Furthermore, for the sake of clarity, the Y-direction has been oriented to point forward along a horizontal plane in the figures, the X-direction has been oriented to point left along the horizontal plane in the figures, and the Z-direction has been oriented to point upwards along a vertical plane in the figures. All of this is done realizing that such snow plow assemblies can be raised, lowered, inclined, declined, canted, etc., such as when being used on a vehicle.

Referring to FIGS. 1A, 1B, 2A, 2B, 3A, 3B, 4A, 4B, and 5A-C, an exemplary snow plow assembly 10 is shown. The snow plow assembly 10 generally includes a push frame 12 to which a moldboard 14 is mountable for enabling removal of snow, and a lift frame 16 configured for mounting to a vehicle 18 (shown in phantom). As discussed in further detail below, the snow plow assembly 10 also includes one or more couplings 20 configured to floatably attach the push frame 12 to the lift frame 16, for enabling the snow plow assembly 10 to facilitate snow removal by accommodating for irregular or uneven ground surfaces encountered by the vehicle 18 and/or snow plow assembly 10 when in use. Also as discussed in further detail below, the one or more couplings 20 may be configured to improve distribution of the loads exerted on portions of the push frame 12 to help reduce stress and wear.

Figure 1A:
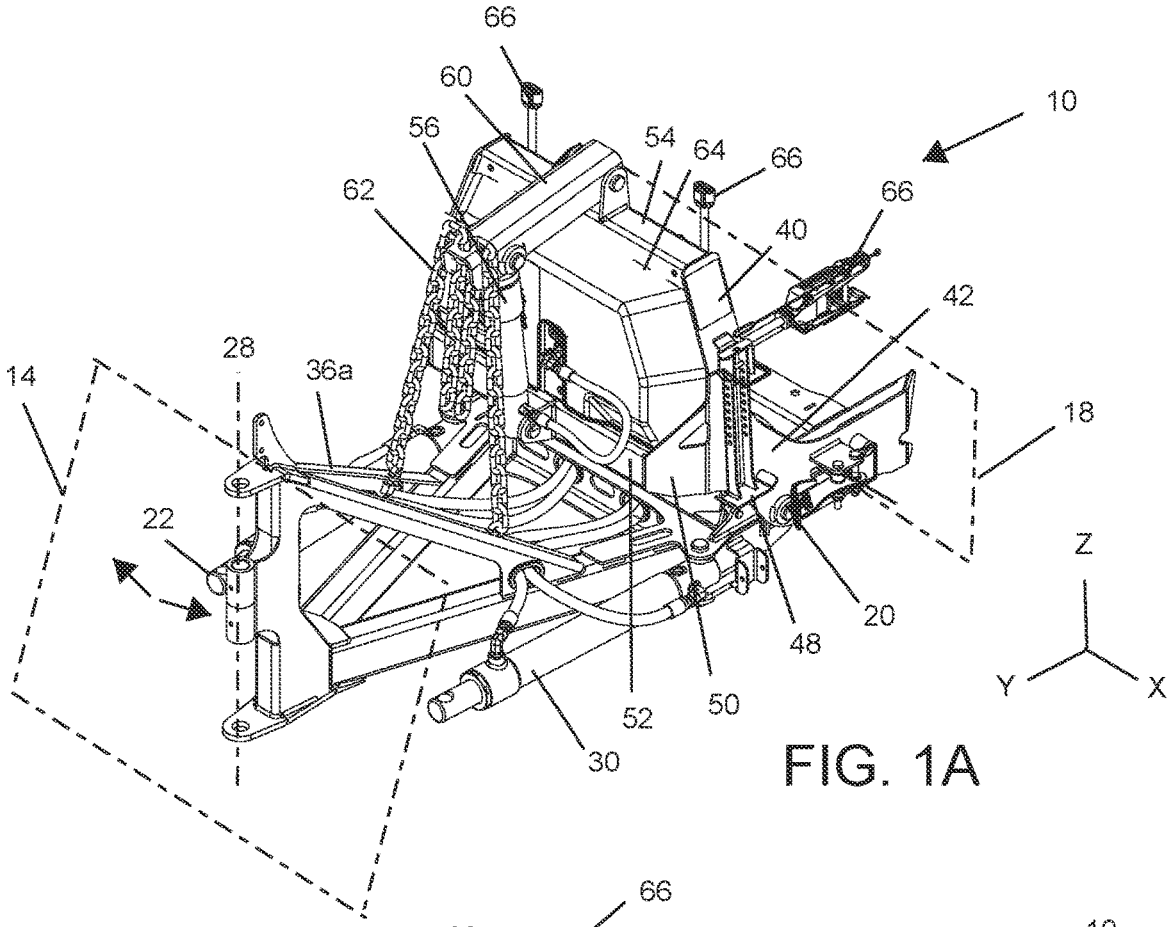
FIGS. 1A and 1B are perspective views of the present snow plow assembly, respectively depicting the drop foot in stowed and deployed positions in accordance with the present invention.
Figure 1B:
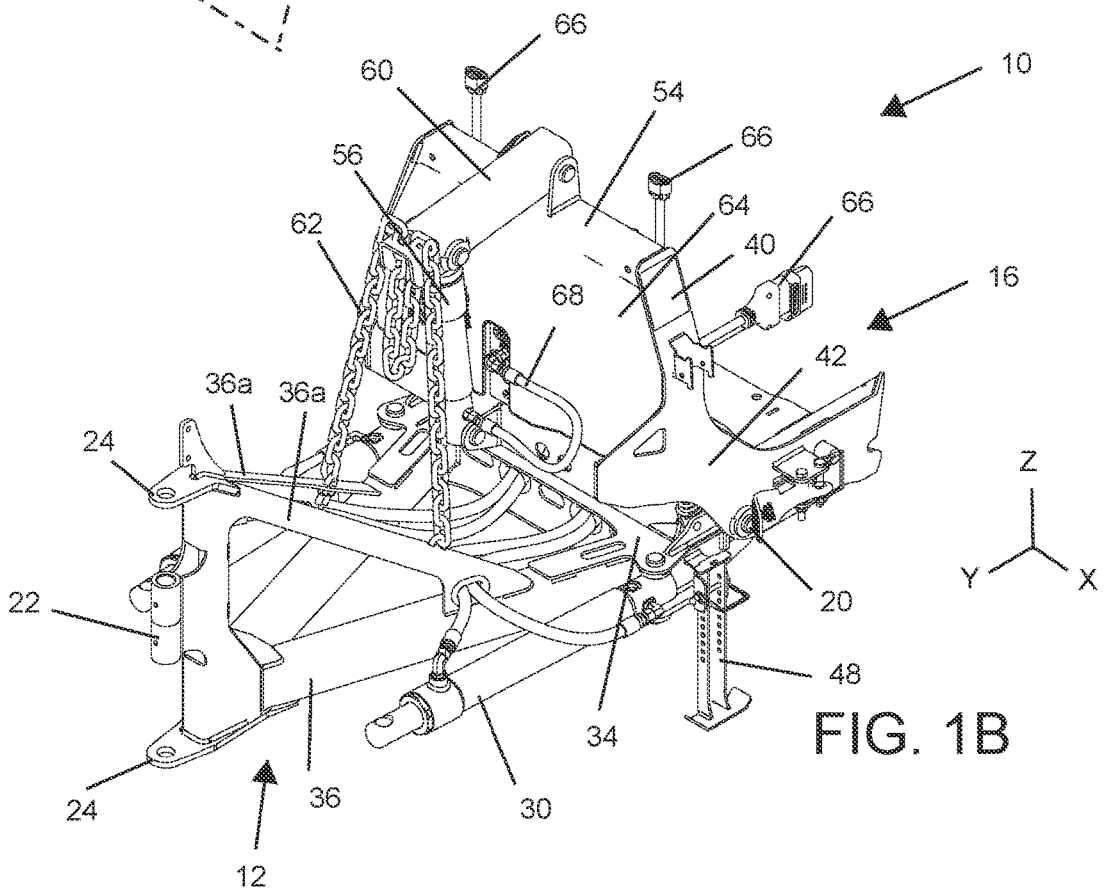

As particularly shown in FIGS. 1A and 1B, the snow plow assembly 10 includes a mounting bar 22 having one or more mounting interfaces 24, such as suitable brackets or the like, for operatively mounting the moldboard 14 to the push frame 12. As shown, the mounting interface 24 can be a defined as flat plates having mounting holes 26 for enabling lateral pivoting movement (e.g., left/right pivoting movement) of the moldboard 14 relative to the push frame 12 about a vertical pivot axis 28. One or more pivot devices 30 can be mounted on the left and/or right sides of the push frame 12, and connected to the moldboard 14, to enable the pivoting movement of the moldboard 14 about the pivot axis 28. In the illustrated embodiment, the pivot devices 30 are fluid-operated piston-cylinder devices that can extend and retract to provide such pivoting movement to the moldboard 14.

The moldboard 14 (shown in phantom in FIG. 1A) can be any suitable type of moldboard or moldboard assembly, such as a straight moldboard, a V-shaped moldboard, or the like, and can have one or more plow blade edges for engaging the ground. The moldboard 14 can have corresponding mounting interfaces for mounting to the mounting interfaces 24 of the mounting bar 22. It is understood that although the mounting bar 22 is shown mounted to the push frame 12 for operatively coupling the moldboard 14, the moldboard 14 can be directly connected to the push frame 12, either removably or non-removably, and with or without pivoting movement, as may be desirable for particular applications.

With specific reference to FIGS. 1A, 1B, 4A, and 4B, the push frame 12 is configured as an A-frame having rear crossbar 34 and a pair of side bars 36 with corresponding struts 36*a* arranged in a triangular or "A" configuration. The side bars 36 converge in the forward direction to form a vertex portion of the push frame 12 at the bottom of the mounting bar 22. The struts 36*a* extend forward from the side bars 36 generally parallel to the side bars 36 and extending upward to converge at the top of the mounting bar 22. The rear crossbar 34 extends in a transverse direction and is operatively connected to the side bars 36 via any suitable means, such as welding or fastening. It is understood that although the push frame 12 is shown as being a multiple component construction, one or more of the components of the push frame 12 shown in the illustrated embodiment may be integral and unitary with each other.

Figure 2A:
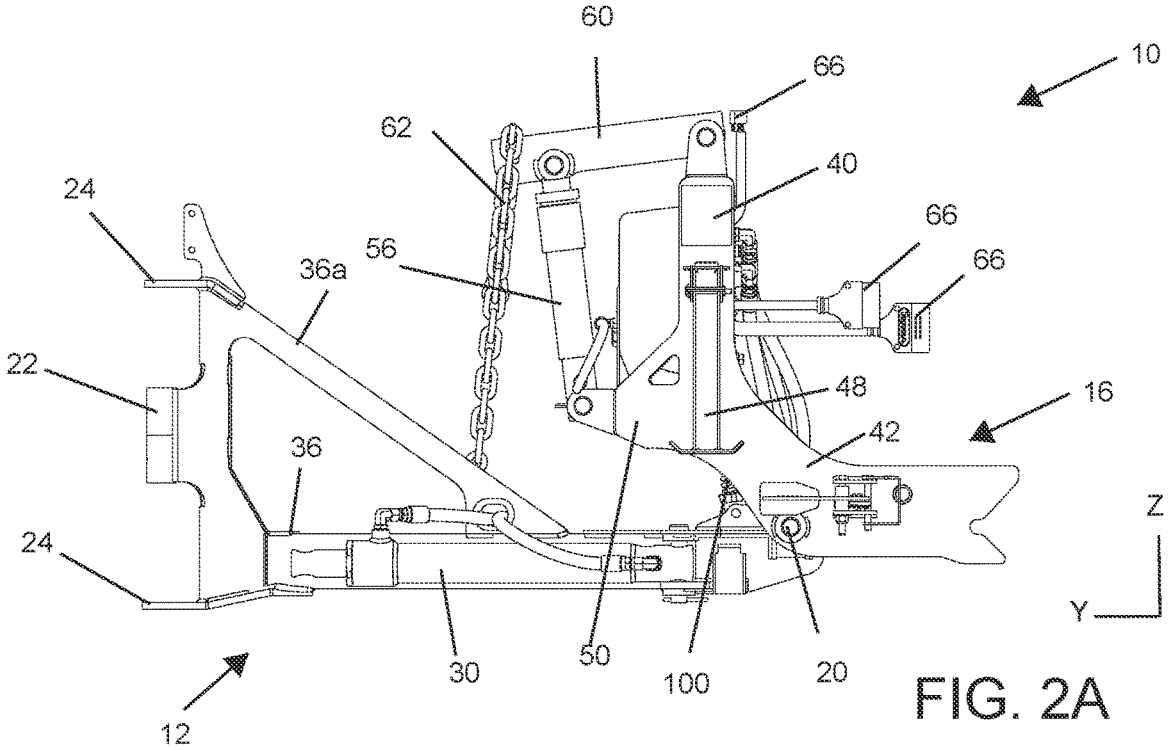
FIGS. 2A and 2B are side views of the present snow plow assembly, respectively depicting the drop foot in stowed and deployed positions in accordance with the present invention.
Figure 2B:
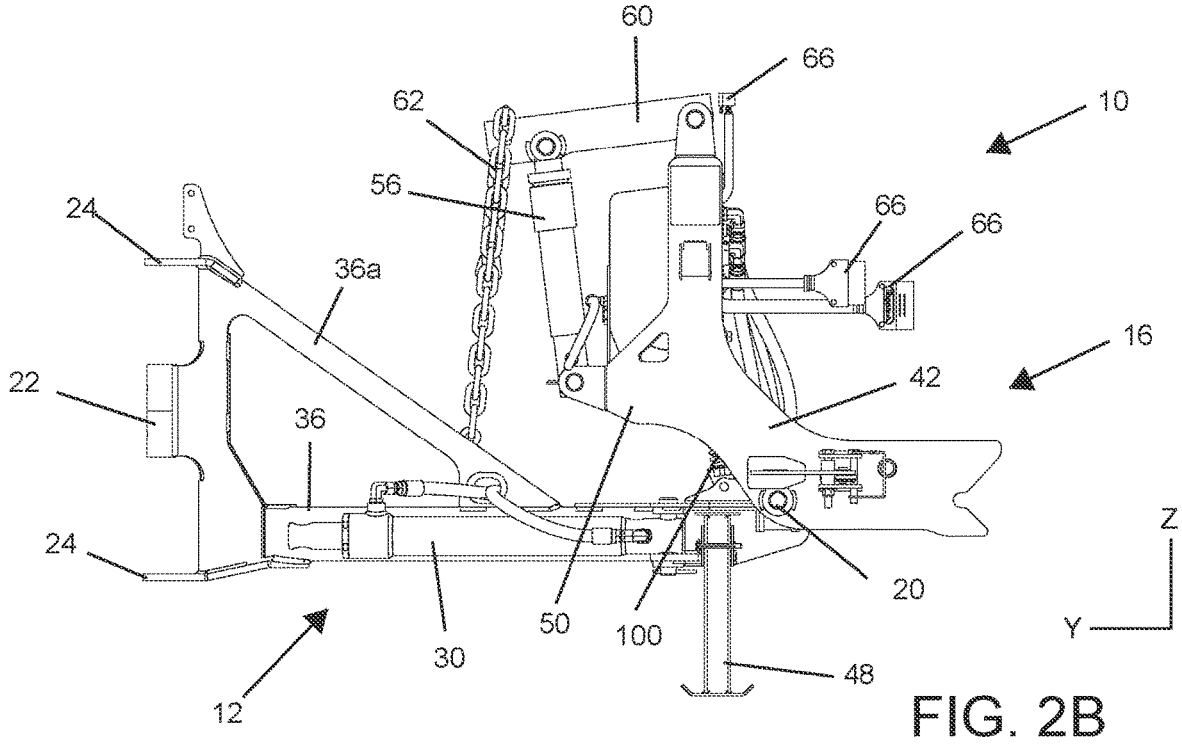
Figure 3A:
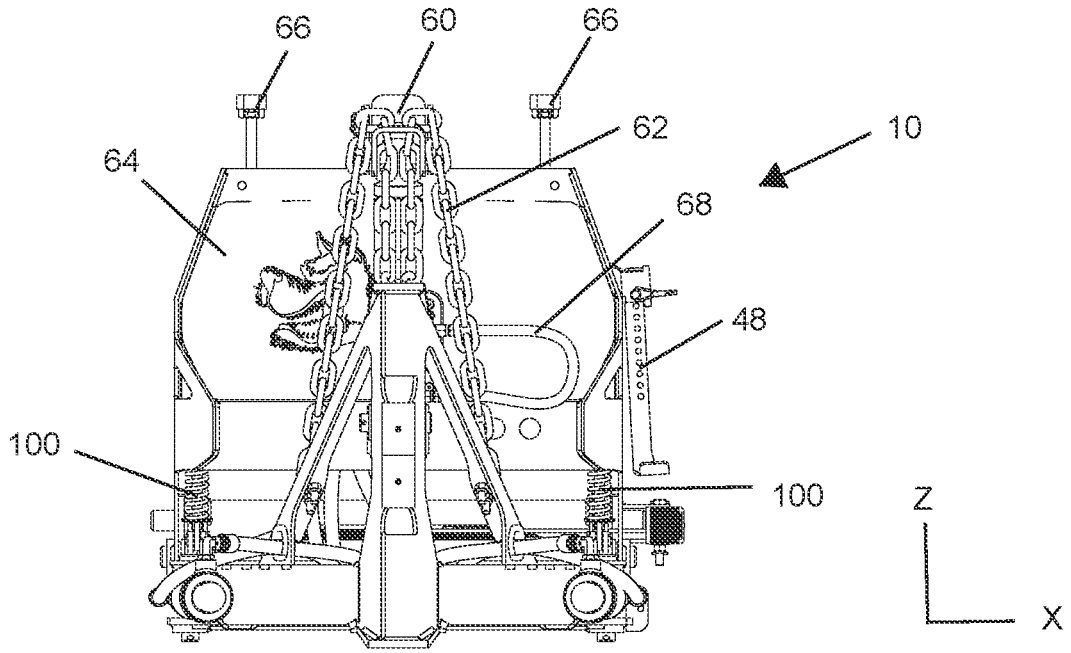
FIGS. 3A and 3B are respective front and rear views of the present snow plow assembly in accordance with the present invention.
Figure 3B:
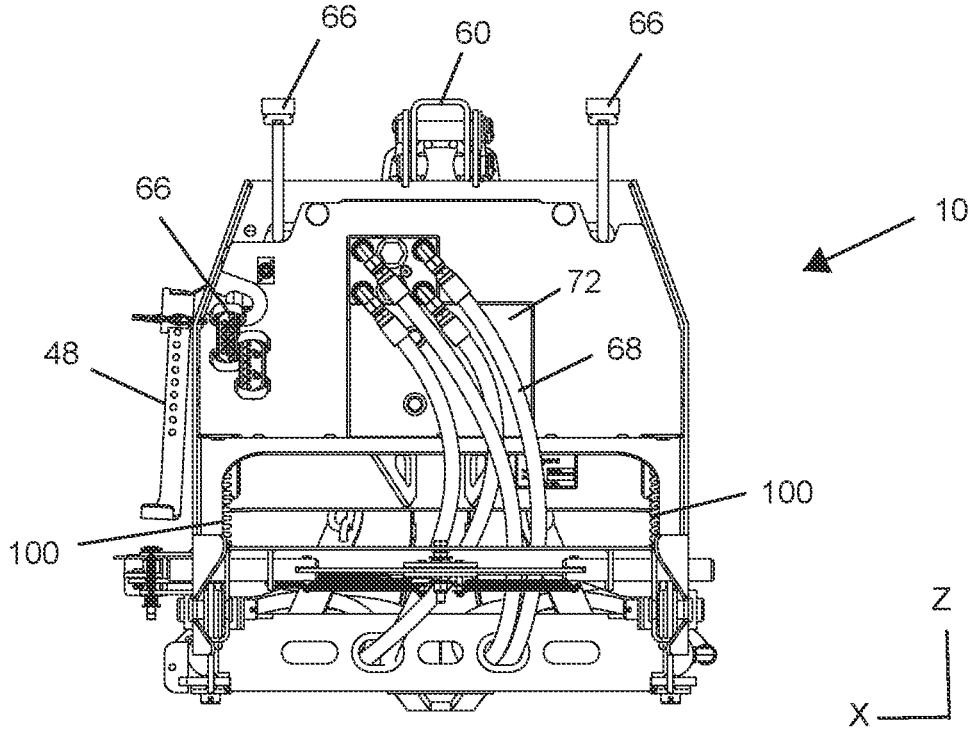

As shown especially in FIGS. 1A, 1B, 2A, and 2B, the lift frame 16 is generally vertically oriented and includes an upper portion 40 that extends upright above the push frame 12, and a lower portion 42 that is coupled to the push frame 12. The lower portion 42 also is operatively coupled to the vehicle 18. The vehicle 18 may be any suitable vehicle, such as commercial, industrial, commuter, residential, or all-purpose vehicle. The lift frame 16 also can include one or more stand assemblies 48 that are vertically pivotable downward to support at least a portion of the snow plow assembly 10, such as when the snow plow assembly 10 is detached from the vehicle 18. The stand assemblies 48 can be a "kickstand" or "drop foot" which mounts onto the side of the lift frame 16 in a stowed position as shown in FIGS. 1A and 2A. The stand assemblies 48 can then vertically drop down from the side of the lift frame 16 in a deployed position as shown in FIGS. 1B and 2B to stably support the snow plow assembly 10, especially when detached onto a hill or other sloped surface. It is understood that the lift frame 16 could be directly removably mountable to the vehicle 18, or removably mountable using an intervening mounting structure, or permanently attached to the vehicle 18, as may be desirable for particular applications.

As especially seen in FIG. 1A, 1B, 2A, and 2B, the lift frame 16 includes a pair of vertical support members 50 that are transversely spaced apart frame one another. One or more transverse crossmembers 52 can connect the vertical cross members 50 at the upper portion 40 of the lift frame 16. As shown, a lift device 56 is mounted to the lift frame 16 and is also operatively coupled to the push frame 12 such that activation of the lift device 56 vertically raises or lowers the push frame 12 and the moldboard 14 relative to a horizontal X-Y plane. In the illustrated embodiment, a forwardly extending lift arm 60 is operably coupled to a crossmember 54, and one or more tethers 62, such as a chain or other suitable linkage, operably connects the lift arm 60 to the push frame 12. The lift device 56 is coupled to the cross member 52 on one end of the lift device, and is connected to the lift arm 60 at the opposite end of the lift device 56. In the illustrated embodiment, the lift device 56 is a fluid operated piston-cylinder device in which extension or retraction of the device causes the lift arm 60 to pivot upwards or downwards relative to the crossmember 54 and the vertical support members 50, thereby causing the forward portion of the push frame 12 to raise or lower via the chain 62.

As shown especially in FIGS. 1A, 1B, 3A, and 3B, the lift frame 16 also includes a housing 64 that spans the space between the vertical support members 50. The housing 64 can contain electronic and/or fluid (e.g., hydraulic) devices and can act as a shield to the snow. As shown, one or more electrical conduits 66 and/or one or more fluid conduits 68 can extend from the housing 64 to provide a source of power to one or more of the pivot devices 30, lift device 56, and/or lights (not shown). The housing 64 may contain one or more access panels 72 for accessing the internal chamber of the housing 64.

Referring particularly to FIGS. 1A, 1B, 2A, and 2B, the couplings 20 are shown in further detail. As shown, the snow plow assembly 10 may include first and second couplings 20, with a first coupling 20 attaching a left side of the push frame 12 to a corresponding left side of the lift frame 16, and a second coupling 20 attaching a right side of the push frame to a corresponding right side of the lift frame. As discussed above, the couplings 20 can be configured to allow each of the left and right sides of the push frame 12 to float vertically relative to the respective left and right sides of the lift frame 16. The couplings also can be configured to allow the left and right sides of the push frame 12 to float vertically independently of one another. This independent floating movement of each of the couplings 20 allows the push frame 12 to rotate relative to the lift frame 16 about a longitudinal axis connecting the couplings, which enables the snow plow assembly 10 to accommodate for irregular or uneven ground surfaces when the snow plow assembly is in use.

As particularly shown in FIGS. 5A and 5B, the couplings 20 each include a retaining member or pin 84 for operatively coupling the push frame 12 to the lift frame 16. The couplings 20 also may include at least one rectangular bearing block 90 at least partially interposed between the retaining member 84 and the push frame 12 in the forward and/or rearward longitudinal directions.

With continued reference to FIGS. 5A and 5B, the bearing blocks 90 also can be configured to enable the vertical floating movement of the push frame 12 relative to the lift frame 16. As illustrated, the retaining member 84 is configured to protrude outwardly of the outer bearing block 90 to allow for connection to respective inner and/or outer portions of the lift frame 16. As illustrated, the retaining member 84 is configured as a cylindrical pin having a head on one end and a catch, such as a cotter pin, on the opposite end. The retaining member 84 is preferably configured with a sufficient size and made of a suitable material to withstand the loads exerted on the pin without significant plastic deformation when the snow plow assembly 10 is in use.

With particular reference to FIGS. 5A, 5B, 5C, 5D, and 5E, the couplings 20 each include springs 100 for mounting between the push frame 12 and the lift frame 16. The springs 100 are compression springs that include a weldment 102 at a first end of the spring 100 for attaching to the push frame 12. In one alternative aspect, a second weldment can be provided at a second end of the spring 100, opposite from the first end, for attaching to the lift frame 16. As illustrated in FIGS. 5D and 5E, the springs 100 are mounted concentrically around a bar 104, which is inserted through a washer 106, which is further inserted through an aperture in a strut 108 secured to the lift frame 16 at the second end of the spring 100, opposite from the first end. The bar 104 is retained in the frame 108 by the coupling 20 which secures the lift frame 16 to the push frame 12. The bar 104 can move freely through the aperture in the frame 108. The springs 100 provide support to the lift frame 16 and to generally provide support to the snow plow assembly 10. In this manner, the springs 100 provide a secure, mobile connection between the push frame 12 and the lift frame 16 to help prevent the snow plow assembly 10 from falling over when detached from the vehicle 18. In this manner, the snow plow assembly 10 can remain upright and thereby can be mounted and unmounted by a single person, no longer requiring two personnel for this procedure.

With continued reference to FIGS. 5A, 5B, 5C, 5D, and 5E, the springs 100 provide an additional function of providing support to the pins 84 (i.e., the retaining members 84) as they move in the vertical slots 86. Thus, the springs 100 provide a biasing force against the pins 84, which results in a balancing force that maintains the centering of the snow plow assembly 10. In one alternative embodiment, torsion springs can be employed instead of the coil springs 100 as shown. In another alternative embodiment, extension springs can be employed instead of the coil springs 100 as shown. In yet another alternate embodiment, gas shocks can be used instead of the springs 100 as shown.

It is understood that although a preferred configuration of the exemplary snow plow assembly 10 including the floating coupling(s) 20 has been described and shown, it would be apparent to those having ordinary skill in the art that other push frame 12 and/or lift frame 16 designs could also be used with the present invention. The invention is not limited to any particular snow plow assembly design, but rather is appropriate for a wide variety of commercially-available snow plow assemblies. Furthermore, although the principles and aspects of the present invention have particular application to snow plow assemblies, it is understood that such principles and aspects may be applicable to other plow assemblies in general, or to other vehicle mounted or machine accessories upon which forces are exerted and which may be desirable to provide one or more floatable couplings that allow independent movement relative to each other and/or cooperate to provide rotational movement, and/or where it is desirable to provide one or more bearing blocks in the coupling to improve the load distribution, such as for vehicle-mounted rotating brushes, or the like.

Numerous embodiments have been described herein. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

Having thus described the invention, it is now claimed:

1. A snow plow assembly for a vehicle, the snow plow assembly comprising:

a push frame to which a moldboard is mountable for enabling removal of snow;

a lift frame configured for mounting to the vehicle;

a lift device mounted to the lift frame, the lift device configured to vertically raise or lower the push frame and the moldboard relative to a horizontal plane;

a first coupling and a second coupling, the first coupling attaching a left side of the push frame to a corresponding left side of the lift frame, and the second coupling attaching a right side of the push frame to a corresponding right side of the lift frame; and wherein the first and second couplings each comprise a spring for mounting between the push frame and the lift frame, wherein each of the springs further comprise a first weldment at a first end of the respective spring for attaching to the push frame, wherein each spring is mounted concentrically around a respective bar, which is inserted through an aperture in a strut secured to the lift frame at a second end of the spring, opposite from the first end, for attaching to the lift frame, wherein the springs provide support to the lift frame to help prevent the snow plow assembly from falling over when detached from the vehicle and to hold the snow plow upright during mounting and dismounting.

2. The snow plow assembly of claim 1, further comprising at least one stand assembly, vertically pivotable downward to support at least a portion of the snow plow assembly when detached from the vehicle.

3. A snow plow assembly for a vehicle, the snow plow assembly comprising:

a push frame to which a moldboard is mountable for enabling removal of snow;

a lift frame configured for mounting to the vehicle;

a lift device mounted to the lift frame, the lift device configured to vertically raise or lower the push frame and the moldboard relative to a horizontal plane;

a first coupling and a second coupling, the first coupling attaching a left side of the push frame to a corresponding left side of the lift frame, and the second coupling attaching a right side of the push frame to a corresponding right side of the lift frame;

wherein the first and second couplings each include a bearing member having an opening that receives a retaining member that operatively couples the push frame to the lift frame; and wherein the first and second couplings each comprise a spring for mounting between the push frame and the lift frame, wherein each of the springs further comprise a first weldment at a first end of the respective spring for attaching to the push frame, wherein each spring is mounted concentrically around a respective bar, which is inserted through an aperture in a strut secured to the lift frame at a second end of the spring, opposite from the first end, wherein the springs provide support to the respective retaining members and provide a biasing force against the respective retaining members, resulting in a balancing force that maintains centering of the snow plow assembly.

4. The snow plow assembly of claim 3, further comprising at least one stand assembly, vertically adjustable downward to support at least a portion of the snow plow assembly when detached from the vehicle.

5. A snow plow assembly for a vehicle, the snow plow assembly comprising:

a push frame to which a moldboard is mountable for enabling removal of snow;

a lift frame configured for mounting to the vehicle;

a lift device mounted to the lift frame, the lift device configured to vertically raise or lower the push frame and the moldboard relative to a horizontal plane;

a first coupling and a second coupling, the first coupling attaching a left side of the push frame to a corresponding left side of the lift frame, and the second coupling attaching a right side of the push frame to a corresponding right side of the lift frame;

wherein the first and second couplings each include a bearing block having an opening that receives a retaining member that operatively couples the push frame to the lift frame;

wherein the respective bearing blocks of the first and second couplings are configured to vertically move with the respective retaining members when the snow plow assembly is in use to thereby allow each of the left and right sides of the push frame to float vertically relative to the respective left and right sides of the lift frame, and are configured to allow the left and right sides of the push frame to float vertically independently of one another, thereby allowing the push frame to rotate relative to the lift frame about a longitudinal axis extending in a forward direction, which enables the snow plow assembly to accommodate for irregular or uneven ground surfaces when the snow plow assembly is in use; and wherein the first and second couplings each comprise a spring for mounting between the push frame and the lift frame, wherein each of the springs further comprise a first weldment at a first end of the respective spring for attaching to the push frame, wherein each spring is mounted concentrically around a respective bar, which is inserted through an aperture in a strut secured to the lift frame at a second end of the spring, opposite from the first end, for attaching to the lift frame, wherein the springs provide support to the lift frame to help prevent the snow plow assembly from falling over when detached from the vehicle, and to provide a biasing force against the respective retaining members, resulting in a balancing force that maintains centering of the snow plow assembly.

6. The snow plow assembly of claim 5, further comprising at least one stand assembly, vertically pivotable downward to support at least a portion of the snow plow assembly when detached from the vehicle.

* * * * *